US008941543B2

(12) United States Patent
Chen

(10) Patent No.: US 8,941,543 B2
(45) Date of Patent: Jan. 27, 2015

(54) APPARATUS FOR A CASE FOR AN ELECTRONIC DEVICE

(71) Applicant: Wah Hong Industrial Corp., Kaohsiung (TW)

(72) Inventor: Ko-Chun Chen, Kaohsiung (TW)

(73) Assignee: Wah Hong Industrial Corp., Kaohsiung (TW)

( * ) Notice: Subject to any disclaimer, the term of this patent is extended or adjusted under 35 U.S.C. 154(b) by 0 days.

(21) Appl. No.: 14/159,776

(22) Filed: Jan. 21, 2014

(65) Prior Publication Data

US 2014/0203975 A1 Jul. 24, 2014

Related U.S. Application Data

(60) Provisional application No. 61/754,950, filed on Jan. 21, 2013.

(51) Int. Cl.
*H01Q 1/24* (2006.01)
*H01Q 1/12* (2006.01)

(52) U.S. Cl.
CPC ..... *H01Q 1/12* (2013.01)
USPC ..... 343/702

(58) Field of Classification Search
USPC ..... 343/702, 700 MS, 895
See application file for complete search history.

(56) References Cited

U.S. PATENT DOCUMENTS

| | | | | |
|---|---|---|---|---|
| 6,885,347 | B2 * | 4/2005 | Zheng et al. | 343/702 |
| 2011/0032153 | A1 * | 2/2011 | Hong et al. | 343/700 MS |
| 2011/0109514 | A1 * | 5/2011 | Galeev | 343/702 |

* cited by examiner

*Primary Examiner* — Hoang V Nguyen
(74) *Attorney, Agent, or Firm* — Ascenda Law Group PC

(57) ABSTRACT

An apparatus for a case for an electronic device containing one or more antennas is disclosed. The apparatus for the electronic device comprises a metal layer, a dielectric layer and a masking layer, wherein the masking layer has one or more channels, and some of the channels have antenna therein. The antenna extends from one wall to another wall of the case.

13 Claims, 9 Drawing Sheets

Fig. 5B-B
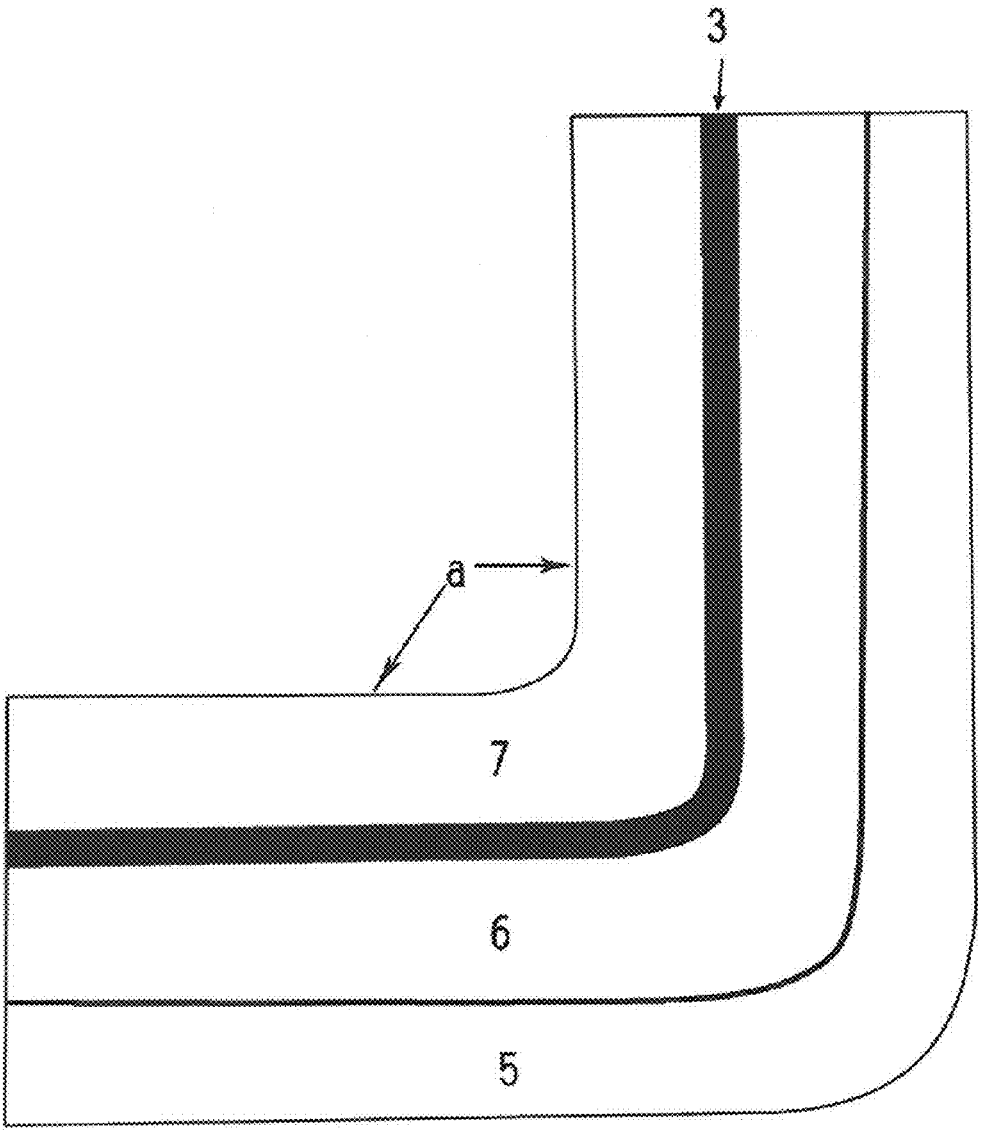

APPARATUS FOR A CASE FOR AN ELECTRONIC DEVICE

CROSS-REFERENCE TO RELATED APPLICATIONS

This application claims priority to U.S. Provisional Patent Application No. 61/754,950, filed Jan. 21, 2013, entitled Apparatus for an Electronic Device, listing Ko-Chun Chen as an inventor, the entire contents of that application being incorporated herein by reference in its entirety.

BACKGROUND

Antennas emitting or receiving telecommunication signals are basic units of a mobile communication device. As the size of such devices continues to shrink, antennas are frequently incorporated into the cases of such devices and various methods to produce thinner cases are developed to meet this demand. For example, antenna can be manufactured with a flexible printed circuit board or a die-cut metal foil piece, which is then inject-molded with resin to form a phone case. Compared to a metal case of the same strength, a resin case is much thicker than a metal case.

Generally, an antenna must be of a certain operating length in order to function adequately. As the size of electronic devices continue to shrink, antennas are getting shorter than the optimal operating length, leading to the continuance of dropped phone calls.

Accordingly, there is a need for improved ways of incorporating antennas into the case of an electronic device, wherein the case is thin enough and strong enough to meet market requirements, yet provides adequate antenna operating length for proper operation.

BRIEF SUMMARY OF AN EXEMPLARY EMBODIMENT

One embodiment is directed to an apparatus, comprising a case for an electronic device and one or more antennas. The case comprises a bottom wall 1 and one or more side walls 2, as illustrated in FIG. 1. At least a portion of the antennas 3 are on two or more of said walls and extend continuously from one of said walls to another of said walls. In at least some embodiments, by extending the antenna 3 from one wall to another wall in a continuous fashion (i.e., without any interruption of the antenna where the walls meet), a longer operating length is achieved without expanding the size of the apparatus.

In another embodiment, as illustrated in FIG. 3, the apparatus comprises a multi-layer structure 10 for an electronic device, wherein the multi-layer structure 10 comprises a metal layer 5, a dielectric layer 6 and a masking layer 7. The metal layer 5, the dielectric layer 6 and the masking layer 7 each comprises a top surface, a bottom surface and at least one side wall. The masking layer 7 further comprises one or more channels 8 extending continuously along at least a portion of the top surface of the masking layer 7 and at least a portion of the side wall of the masking layer, and one or more channels 8 contain antenna 3 therein. A the channels portion of the antenna 3 within 8 extends from at least a portion of the top surface of the masking layer 7 and a least a portion of the side wall of the masking layer 7 in a continuous fashion.

At least some exemplary embodiments are directed to an electronic device, comprising an apparatus as described herein.

BRIEF DESCRIPTION OF THE DRAWINGS

Other features and utilities of embodiments detailed herein and/or variations thereof will become apparent in the following detailed description of some exemplary embodiments with reference to the accompanying drawings, in which:

FIG. 5 illustrates schematically a cross sectional view (B-B) in FIG. 1.

DETAILED DESCRIPTION

Definition

As employed above and throughout the disclosure, the following terms, unless otherwise indicated, shall be understood to have the following meanings.

As used herein, the singular forms "a," "an," and "the" include the plural reference unless the context clearly indicates otherwise.

The term "electronic device" as used herein, includes, but is not limited to, computers, cellular phones, tablet computer, and the like.

The Apparatus

Figure 1:
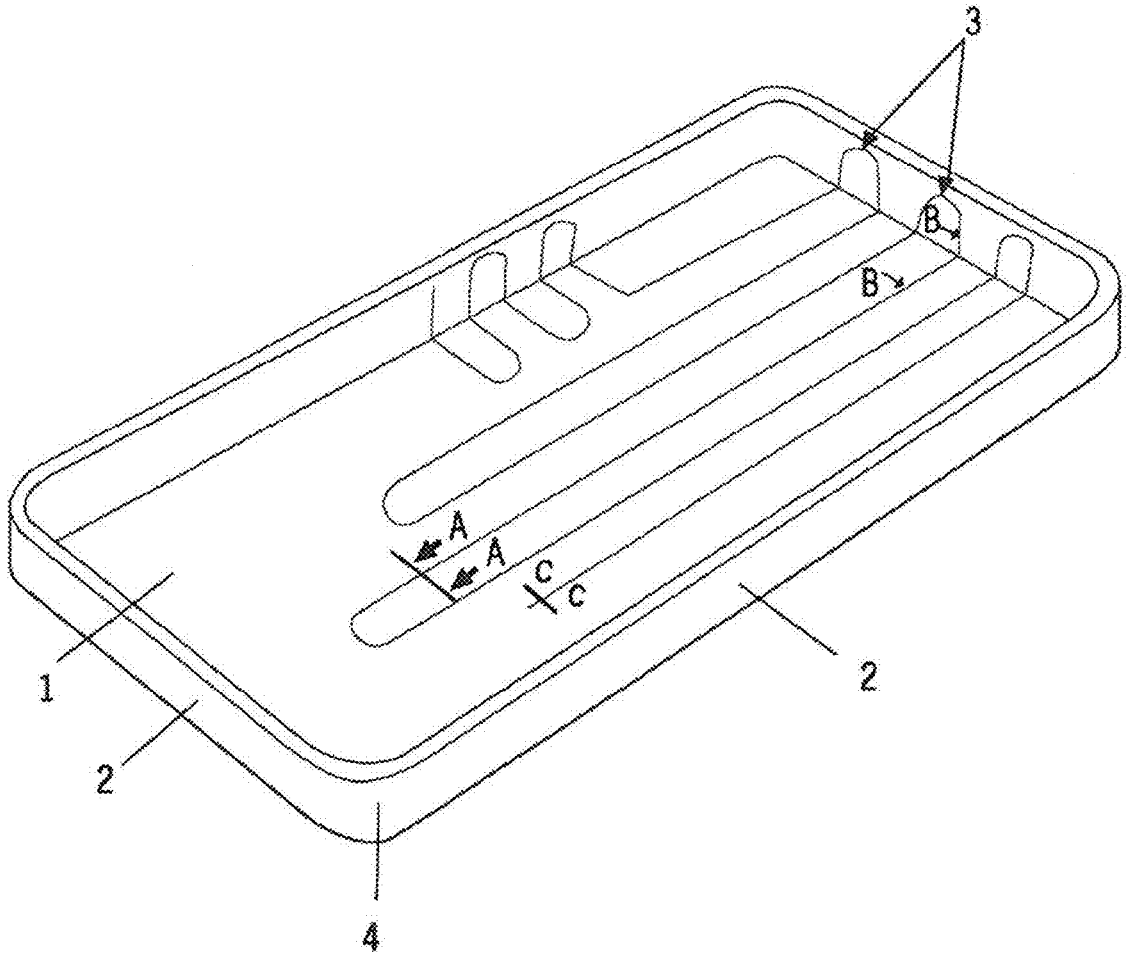
FIG. 1 illustrates schematically an angled top view of one embodiment of the apparatus.
Figure 8:
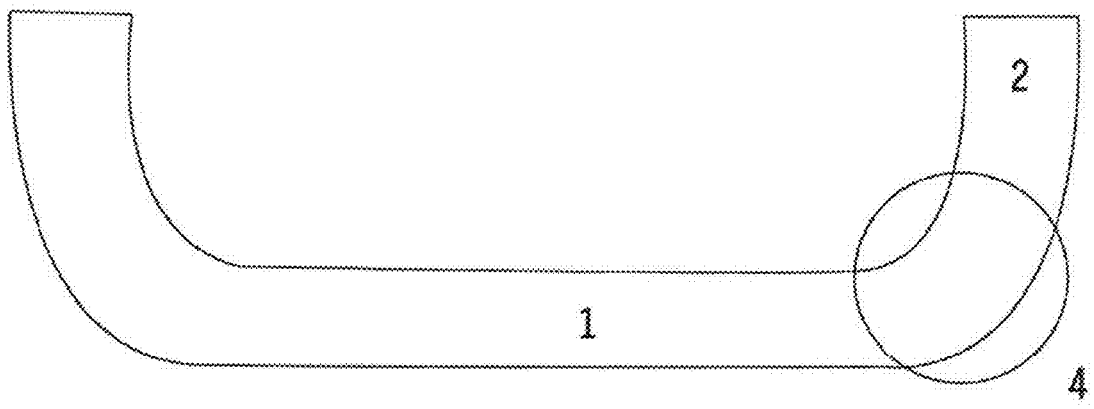
FIG. 8 illustrates a cross sectional view of another embodiment of the apparatus.

FIG. 1 illustrates one embodiment of the apparatus, comprising a case for an electronic device and one or more antennas 3. The case comprises a bottom wall 1 having an internal surface, an external surface, and at least one edge; and at least one side wall 2, each of said side wall having an internal surface, an external surface and at least one edge. The edge of the side wall 2 adjoins the edge of the bottom wall 1. The antenna 3 is on the internal surface of the case and extends continuously from the bottom wall 1 onto at least one side wall 2. In one embodiment, the two side walls are joined by a curved wall 4. In another embodiment, the edge of the side wall 2 adjoins the edge of the bottom wall 1 by a curved wall 4, as illustrated in FIG. 8.

Figure 2:
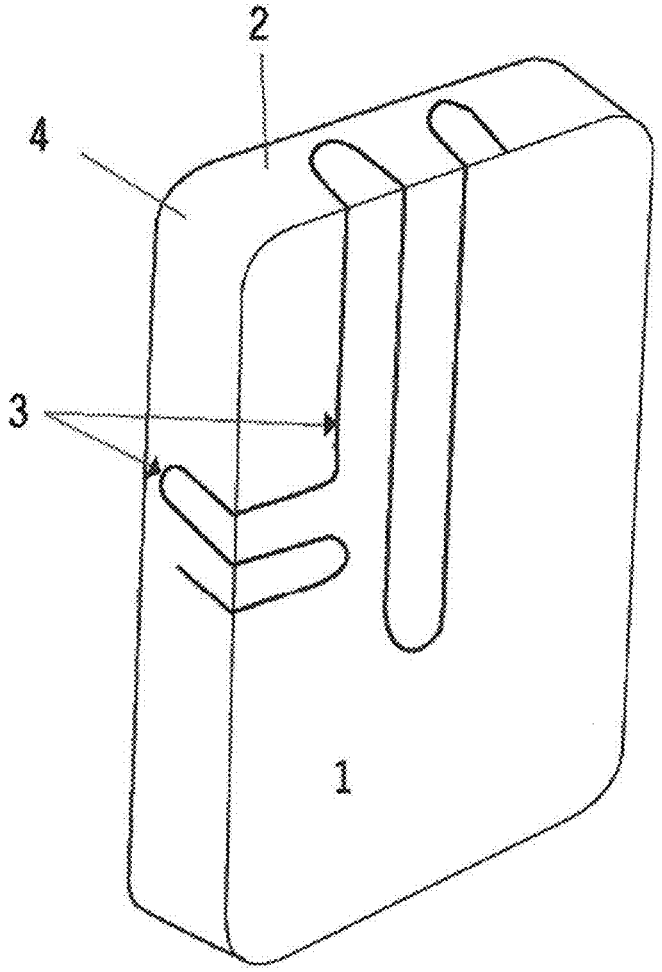
FIG. 2 illustrates schematically an angled bottom view of another embodiment of the apparatus.

FIG. 2 illustrates another embodiment of the apparatus, comprising a case for an electronic device and one or more antenna 3, wherein the antenna 3 is on the external surface of the case and extends continuously from the bottom wall 1 onto at least one side wall 2. In one embodiment, the two side walls are joined by a curved wall 4. In another embodiment, the edge of the side wall 2 adjoins the edge of the bottom wall 1 by a curved wall 4, as illustrated in FIG. 8.

Figure 3:
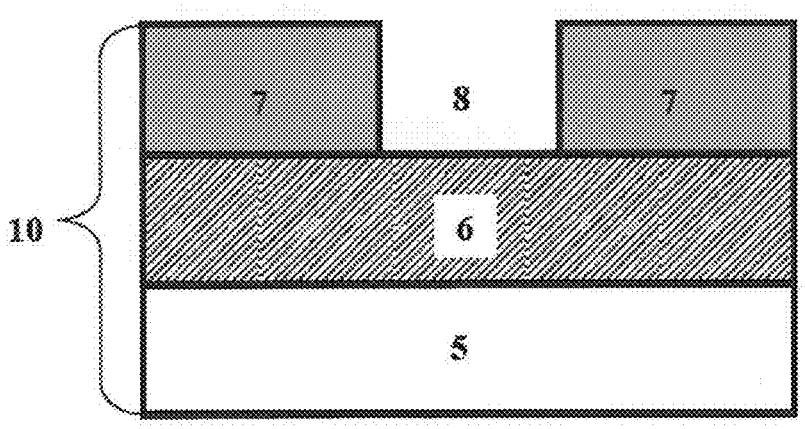
FIG. 3 illustrates schematically a cross sectional view of the apparatus and the channel within the masking layer.

FIG. 3 illustrates the cross sectional view of an apparatus for an electronic device having a multi-layer structure 10. It comprises a metal layer 5; a dielectric layer 6 and a masking layer 7. The masking layer 7 has one or more channels 8. The metal layer 5, the dielectric layer 6 and the masking layer 7 each comprises a top surface, a bottom surface and at least one side wall 2. At least a portion of the channels 8 have antenna 3 therein (see, e.g., FIG. 4A, FIG. 4B, and FIG. 6), and a portion of the antenna 3 extend from one wall to another wall in a continuous fashion (i.e. without any interruption where the walls meet). In one embodiment, the antenna 3 extends continuously from the bottom wall 1 to at least one side wall 2. In another embodiment, the antenna 3 extends continuously from one side wall 2 to another side wall 2. In yet another embodiment, the antenna extends continuously from the bottom wall 1 to the curved wall 4. In yet another embodiment, the antenna extends from the side wall 2 to the curved wall 4.

Referring to FIG. 5, which illustrates the cross section of B-B in FIG. 1. The B-B region is where the edge of the side wall 2 adjoins the edge of the bottom wall 1. Angle $\alpha$ is the angle between the internal surface of side wall 2 and the internal surface of bottom wall 1. In one embodiment, angle $\alpha$ is at least 90 degrees. In another embodiment, angle $\alpha$ is substantially perpendicular. In yet another embodiment, the edge of the side wall 2 and the edge of the bottom wall 1 are joined by a curved wall 4, as illustrated in FIG. 8.

Figure 7:
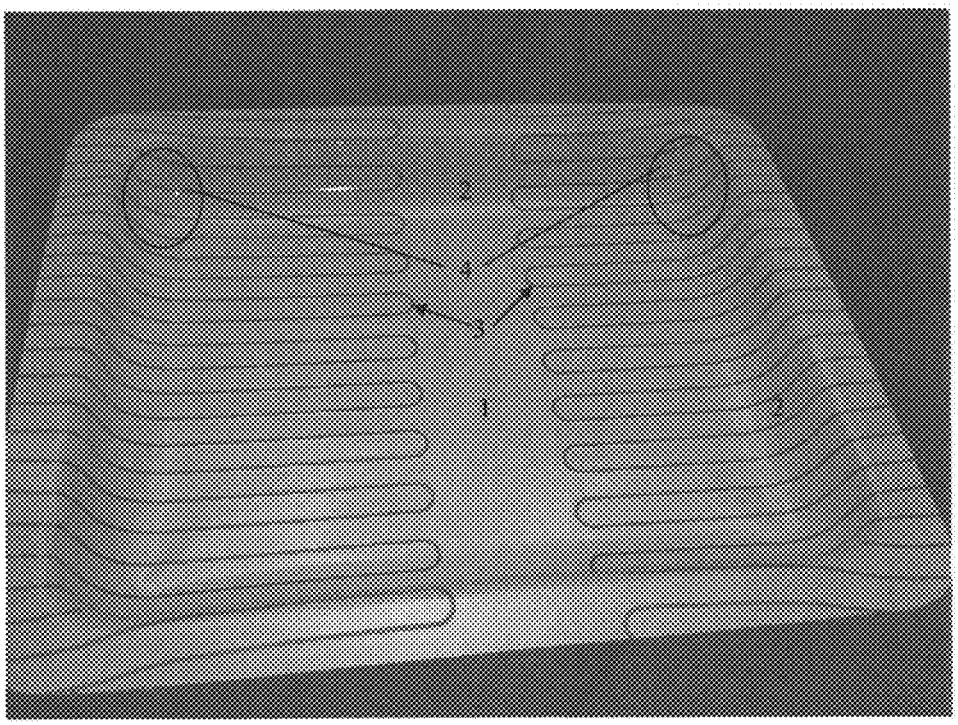
FIG. 7 illustrates schematically an angled top view of another embodiment of the apparatus.

Referring to FIG. 7, the side walls 2 are joined by a curved wall 4, and a portion of the antenna 3 extends to the curved wall 4.

The bottom wall 1 of the case is substantially planar. In one embodiment, the bottom wall 1 further comprises orifices to accommodate other components of the electronic device, such as a camera lens. In another embodiment, the bottom wall 1 further comprises one or more protrusions.

The external surface of the apparatus for an electronic device is covered with or lined by a protective layer. Non-limiting examples of the protective layer are plastic film, a layer of paint, or a layer with a special function as required.

In one embodiment, the multi-layer structure 10 comprises a metal copper clad laminate (MCCL), which comprises a metal layer, a dielectric layer and a copper layer.

Antenna

The antennas 3 are disposed or embedded in the channels 8 within the masking layer 7. In one embodiment, the antennas 3 are on the internal surface of the case, as illustrated in FIG. 1. In another embodiment, the antennas 3 are on the external surface of the case, as illustrated in FIG. 2.

The antenna 3 comprises electrically conductive material. In some embodiments, the electrically conductive material has a relative permeability of about 1, or a resistivity of less than about 1. The electrically conductive material can be selected from appropriate materials for constructing antenna. Examples of such materials include the following: copper, silver, aluminum such as 7XXX annealed (Zal), zinc, brass, nickel, iron, tin, fusible alloys, such as Solder 63/37 Eutectic alloy, steel such as carbon steel or mild steel, lead, stainless steel, or mixtures thereof.

In one embodiment, the antenna traces are added to the dielectric layer 6, using light (e.g. laser light).

In another embodiment, a layer of antenna (such as copper) is coated or laminated on the dielectric layer 6 and the undesired portion of antenna is removed by a substractive method, such as etching or pulsed laser, leaving only the desired antenna traces on the dielectric layer.

Figure 4A:
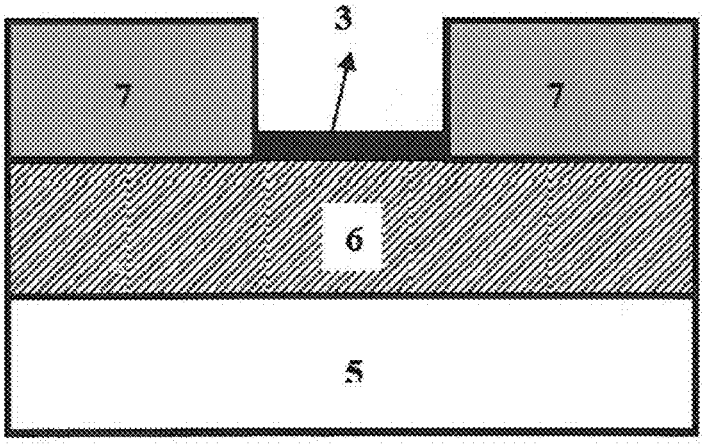
FIG. 4A and FIG. 4B illustrate schematically a cross sectional view (A-A) in FIG. 1.
Figure 4B:
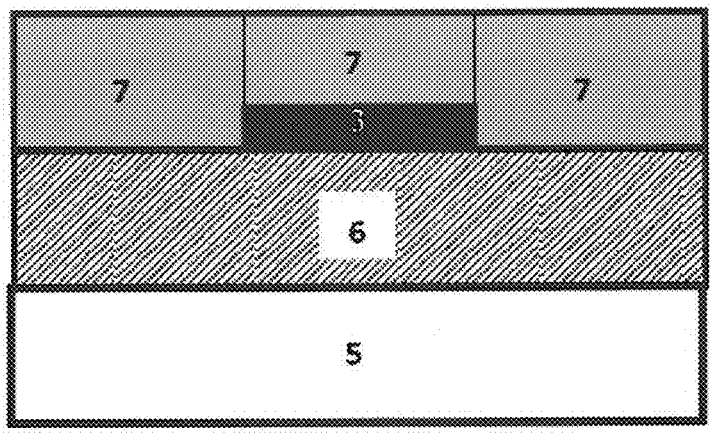
Figure 6:
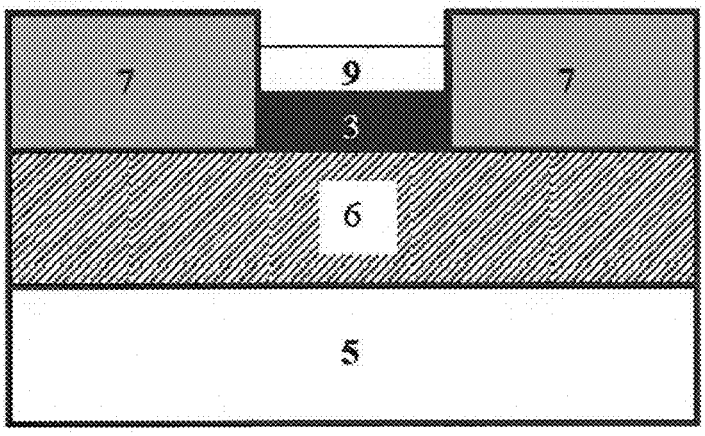
FIG. 6 illustrates schematically a cross sectional view (C-C) in FIG. 1.

In another embodiment, as illustrated in FIG. 4A, the upper surface of the antenna 3 within the channel 8 is substantially free of any coating. In another embodiment, as illustrated in FIG. 4B, the upper surface of the antenna 3 within the channel 8 is coated with the masking layer 7. In yet another embodiment, as illustrated in FIG. 6, the upper surface of the antenna 3 within the channel 8 is electroplated with an anti-oxidation layer 9. The anti-oxidation layer may be of any appropriate material. Such non-limiting examples of the anti-oxidation layer include tin, gold, silver, or an alloy.

Metal Layer

The metal layer 5 used in at least some embodiments provides strength to the apparatus of the electronic device. The metal layer 5 may be constructed of any appropriate material. Examples of such metal layer 5 include the following: aluminum, copper, stainless steel, magnesium alloy, titanium alloy or mixtures thereof.

Dielectric Layer

The dielectric layer 6 used in the case of the electronic device can include any non-conductive substrate. The dielectric layer 6 may be composed of any appropriate material. Non limiting examples of non-conductive substrate include the following: epoxy resin, fiber-filled epoxy, thermal filler, polyimide, polymer, liquid crystal polymer, and a combination thereof.

Masking Layer

The masking layer 7 may be composed of any suitable material. Examples of such suitable materials for the masking layer 7 include, but are not limited to, ink and dry film. The masking film 7 can be applied to the dielectric layer 6 and the antenna 3 by various methods known in the field, such as by screen printing for ink or laminating process for dry film.

A Method of Forming the Apparatus

The apparatus of at least some embodiments can be manufactured by press molding a multi-layer structure 10 at room temperature into a case of an electronic device with a bottom wall 1, one or more side walls 2 and antenna 3, wherein the antenna 3 extending continuously from one of the wall to another wall. The thickness of the multilayer structure 10 is about 0.1 mm to about 2 mm.

The multi-layer structure 10 comprising a metal layer 5, a dielectric layer 6, a masking layer 7 with one or more channels 8, wherein a portion of the channels 8 contain antenna 3 therein. In one embodiment, the multi-layer structure 10 is metal copper clad laminate (MCCL) with a masking layer 7.

In at least some embodiments, the metal layer 5, dielectric layer 6, the masking layer 7, and the antenna 3 are different materials with different bending strength or flexure strength (i.e., ability to resist deformation under load). Hence, the amount of pressure for press molding plays a utilitarian role in (a) avoiding the interruption or fracture of the antenna 3 at where the antenna 3 extends from one wall (e.g. the bottom wall 1) to another wall (e.g. the side wall 2), such as the curved wall 4; (b) avoiding the separation and/or fracture of the metal layer 5, dielectric layer 6, the masking layer 7 where the layers meet, or at the curved wall 4. In one embodiment, about 15 to about 25 tons of pressure is used to press mold a multi-layer structure 10 with a thickness of about 0.6 mm.

What is claimed is:

1. An apparatus, comprising:

a. a metal layer having a top surface, a bottom surface and at least one side wall;

b. a dielectric layer having a top surface, a bottom surface and at least one side wall, at least a portion of said bottom surface of said dielectric layer adjoining at least a portion of said top surface of said metal layer;

c. a masking layer having a top surface, a bottom surface and at least one side wall, at least a portion of said bottom surface of said masking layer adjoining at least a portion of said top surface of said dielectric layer; said masking layer further comprising one or more channels extending continuously along at least a portion of said top surface of said masking layer and at least a portion of said side wall of said masking layer, wherein said one or more channels contain antenna therein, said antenna extending from at least a portion of said channel in said top surface of said masking layer to at least a portion of said channel in said side wall.

2. The apparatus of claim 1, further comprising a protective layer attached to at least a portion of the bottom surface or a portion of the side wall of said metal layer.

3. The apparatus of claim 1, further comprising a protective layer attached to at least a portion of the top surface and a portion of the side wall of said masking layer.

4. The apparatus of claim 3, wherein said substantially planar surfaces are joined to said side walls by a curved wall.

5. The apparatus of claim 1, wherein said surfaces of said layers are substantially planar.

6. The apparatus of claim 5, wherein said substantially planar surfaces are substantially perpendicular to said side walls.

7. The apparatus of claim 5, wherein said substantially planar surfaces are positioned at an angle of at least 90 degrees relative to said side walls.

8. The apparatus of claim 5, wherein a portion of the antenna is coated with the masking layer.

9. The apparatus of claim 1, wherein the antenna is copper.

10. The apparatus of claim 1, wherein the said metal layer is selected from aluminum, copper, stainless steel, magnesium alloy, titanium alloy and combinations thereof.

11. The apparatus of claim 1, wherein the dielectric layer is selected from epoxy resin, epoxy resin and thermal filler, polyimide, polymer, liquid crystal polymer and combinations thereof.

12. The apparatus of claim 1, wherein the masking layer is ink or dry film.

13. The apparatus of claim 1, wherein at least a portion of said antenna is electroplated with an anti-oxidation layer.

* * * * *